United States Patent [19]

Lagneaux

[11] 4,273,288

[45] Jun. 16, 1981

[54] DISPENSING HEAD FOR BEVERAGES

[75] Inventor: Jean Lagneaux, Bourg Argental, France

[73] Assignee: Societe Generale pour l'Emballage, France

[21] Appl. No.: 61,332

[22] Filed: Jul. 27, 1979

[30] Foreign Application Priority Data

Jul. 28, 1978 [FR] France ..... 78 22483

[51] Int. Cl.[3] ..... F23D 11/16

[52] U.S. Cl. ..... 239/419.3; 222/129.3; 239/432; 261/18 R; 261/76; 261/DIG. 7; 366/181

[58] Field of Search ..... 222/129.3, 129.4, 129.2, 222/564, 566, 575, 190; 239/419.3, 426, 422, 432, 590, 597, 598, 593, 521, 518, 524; 137/607, 604; 99/275; 366/177, 181; 261/18 R, 76, 78, DIG. 7

[56] References Cited

U.S. PATENT DOCUMENTS

| | | | |
|---|---|---|---|
| 1,321,976 | 11/1919 | Brown | 239/419.3 |
| 3,016,916 | 1/1962 | Kraft | 239/422 X |
| 3,167,090 | 1/1965 | Booth et al. | 137/604 |
| 3,292,527 | 12/1966 | Stasse | 99/275 X |
| 3,628,444 | 12/1971 | Mazza | 99/275 |

FOREIGN PATENT DOCUMENTS

| | | | |
|---|---|---|---|
| 901160 | 1/1954 | Fed. Rep. of Germany | 239/521 |

*Primary Examiner*—Robert B. Reeves
*Assistant Examiner*—Gene A. Church
*Attorney, Agent, or Firm*—Karl W. Flocks

[57] ABSTRACT

The invention relates to a dispensing head for apparatus for dispensing beverages and especially gaseous beverages.

The head comprises a spout formed of a tubular element 10 of which the internal section increases progressively from the orifice for input of diluting liquid to the discharge orifice and a throat arranged below said tubular element in a position slightly inclined with respect to the horizontal, the passage of the jet of concentrated liquid flowing substantially vertically, being situated in front of the throat and downstream of its end.

9 Claims, 8 Drawing Figures

S
F
14
12
10
30
28
16
26
22
24
20

12
10
26
18
18
22
20

S
F
12
30
32
16
20

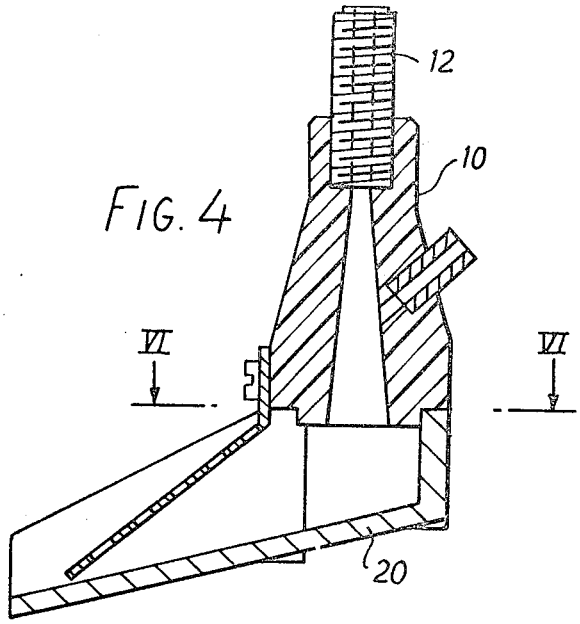
FIG. 4
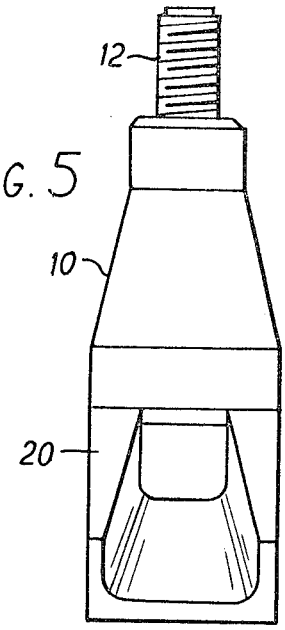
FIG. 5
FIG. 6
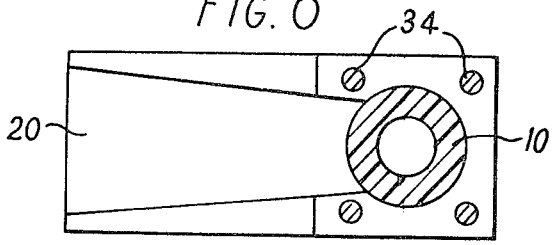
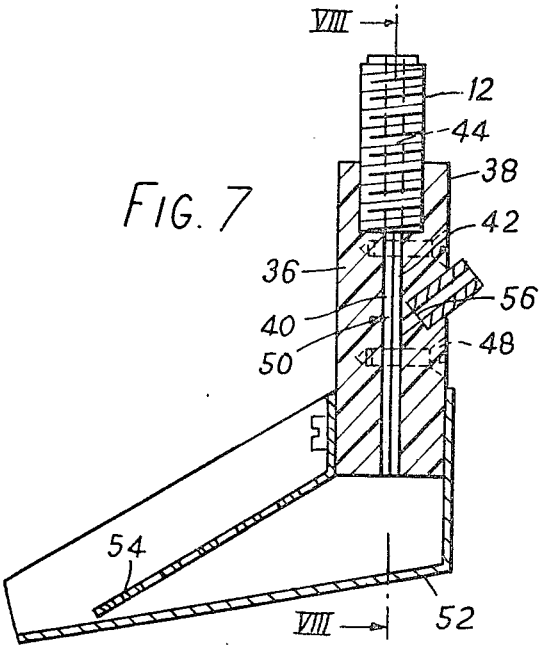
FIG. 7
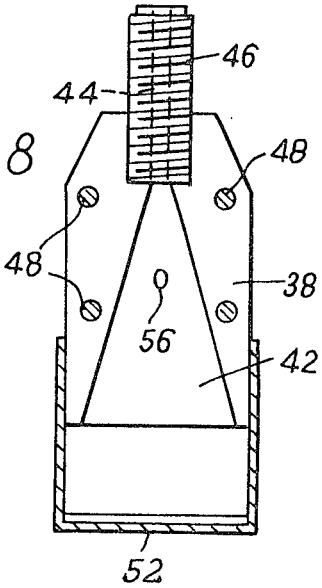
FIG. 8

DISPENSING HEAD FOR BEVERAGES

BACKGROUND OF INVENTION

The present invention relates to a dispensing head for apparatus for dispensing beverages made from a concentrate such as a syrup and especially but not exclusively to gaseous beverages using carbonated water made by the distribution apparatus.

Apparatus for distribution of gasified beverages generally comprise a refrigeration unit, a gasification unit and a unit for dispensing and mixing of the two liquids forming the drink. The dispensing head forms part of this latter unit.

PRIOR ART

Two systems for dispensing and mixing are most commonly used at present.

In the first system, the concentrate is stored in a reservoir such as a metal tank. For each dispensing operation a predetermined volume of concentrate is pumped into the reservoir and brought by a first tube to the distribution head, whereas the dilution liquid, such as refrigerated carbonated water, is fed at the same time in a second tube. At the head the water is brought into a spout provided with a divergence and a lateral duct for injection of concentrate. Mixing of the liquids starts in the spout and continues during the fall towards the drinking receptacle into which the beverage is dispensed and inside the latter. The apparatus comprises as many reservoirs and dispensing heads as the available flavours.

According to another known system, the carbonated water passes through a vertical tube of which the end is closed and the lower end of the cylindrical wall of the tube is pierced with holes regularly distributed around the periphery. These holes are obturated by an external stack of horizontal discs. Under the pressure of the carbonated water, these discs are lifted and allow the carbonated water to pass at their periphery. The carbonated water flows out as a sheet when its speed of ejection from the holes is high and encounters a concentrate fed by a neighbouring feed; if on the other hand the speed of ejection is made fairly low the water passes below these discs to form a downward flow which is concentric with the feed tube and becomes mixed with the concentrate fed by a coaxial tube of smaller diameter.

In another system the concentrate is stored in containers containing the individual doses of concentrate required for preparation of the beverage. In this case a single dispensing head is used for all the flavours required. The containers are opened and emptied directly at the level of the dispensing head. The contact of the two liquids takes place during their fall towards the receptacle for consumption. This, especially in the case where a carbonated water is the diluent, gives rise to difficulties.

Initially the concentrated syrup was fed vertically through an opening and the carbonated water by an inclined spout. The principal difficulty of such a dispensing method resides in the fact that the jet of carbonated water is not very controllable in direction and as the jet of concentrated syrup may also deviate from its normal path the two fluids risk not coming into contact before reaching the receptacle, which spoils the homogeneity of the mixture.

To avoid this disadvantage it has been suggested to feed the diluent liquid through a horizontal tube opening into a chamber in the form of a horizontal crown concentric to a vertical channel by which the concentrate is fed. The crown is pierced by vertical holes of conical shape widening downwardly and arranged concentrically. After having traversed these holes the diluent is recovered in an inverted cone which returns it towards the centre towards the flow of concentrated syrup with which it is mixed.

OBJECT OF INVENTION

The present invention is intended to provide dispensing apparatus having a spout which is usable both for reservoir apparatus and for apparatus using separate doses of concentrate in which the spout is separated from the rest of the dispensing head, the speed of flow of diluent is reduced, there is achieved a reliable first mixing of the diluent with the concentrate during their fall towards the receptacle even in the case of accidental modification of the path of the concentrate, and degasification of carbonated water used as a diluent is reduced to a minimum.

SUMMARY OF INVENTION

According to one aspect of the invention there is provided a dispensing head for dispensing beverages made from a concentrate and a diluting liquid, including a spout comprising a tubular element having input and output orifices for diluting liquid, the cross-section of the bore of the tubular element increasing progressively from the input to the output orifice, a throat or deflector element arranged below said output orifice arranged to conduct liquid from the output orifice in a direction slightly inclined from the horizontal and discharge the liquid from an opening, and means for passing a stream of liquid concentrate in a substantially vertical direction downstream of said opening so that the stream of concentrate and the liquid discharged from the opening intersect.

A grid may be provided within the throat to distribute the diluting liquid across its width.

The diverging part of the tubular element may be of circular section but it may also have any other shape for example rectangular or conic with elliptical section.

DESCRIPTION OF PARTICULAR EMBODIMENTS

Various embodiments will be described by way of example with reference to the accompanying drawings, in which:

FIG. 4 is a view in axial section of a dispensing spout similar to that of FIG. 1 made of plastics material;

FIG. 5 is a view in elevation of the dispensing spout of FIG. 4, the grid having been removed;

FIG. 6 is a view in section along line VI—VI of FIG. 4;

FIG. 7 is a view in axial section of another variant of the dispensing spout; and FIG. 8 is a view in section along line VIII—VIII of FIG. 7.

Figure 1:
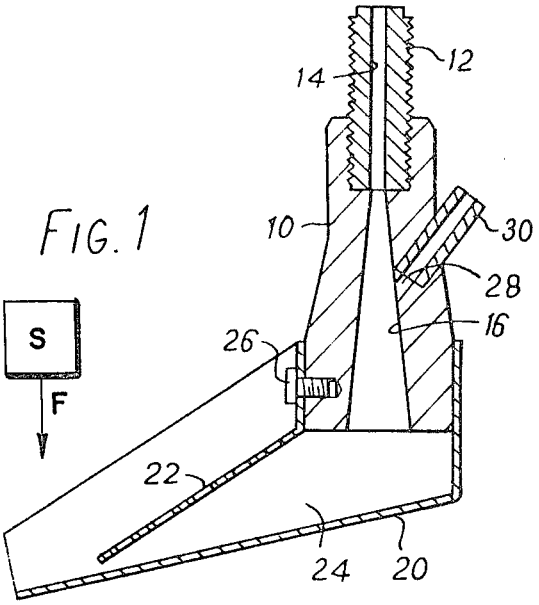
FIG. 1 is a view in axial section of a spout of a dispensing head according to a first embodiment.
Figure 2:
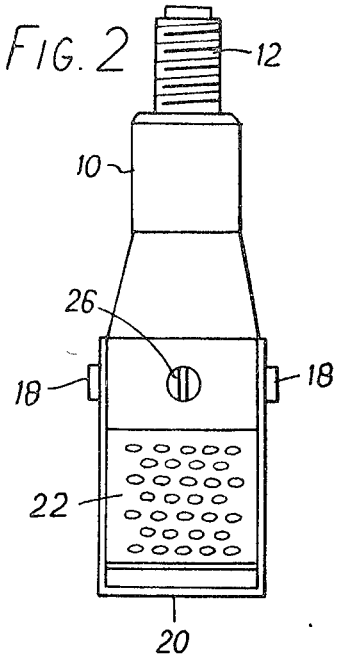
FIG. 2 is a view in elevation of the dispensing spout of FIG. 1.

Referring to FIGS. 1 and 2, the dispensing spout comprises a tubular metal member 10 having a vertical axis of symmetry. At the upper part of the member 10 is fixed, for example by screwing, a tubular metal tip 12 on which may be mounted the end of a duct connected to a saturator for supplying carbonated water, which may be of conventional construction and is not shown in the drawings. The bore 14 of the tip 12 has a relatively small diameter and is prolonged in the member 10 by an axial duct 16 shaped as a truncated cone widening out downwardly to its lower end. The divergent duct 16 plays the role of a progressive expander for the carbonated water. The ratio between the cross-section of duct 16 at the output of the cross-section of the input is of the order of 16.

At the base of the member 10 is fixed by means of screw 18 a throat or deflector element 20 which is slightly inclined downwardly with respect to the horizontal. An inclined grid 22 in the throat 20 defines with the latter a chamber 24 which is open downwardly. The grid 22 is fixed on the member 10 by means of a screw 26. During operation of the device the carbonated water arrives through the tip 14 under a fairly high pressure which corresponds substantially to that in the saturator. It expands progressively in the diverging duct 16, then it falls into the throat or deflector element 20 where it is distributed over the whole width of the throat by the grid 22 before flowing towards a receptacle for consumption below the end of throat or deflector element 20 which is not shown in the drawings.

A thread of concentrated syrup from a source S flows vertically past the end of the throat as shown by arrow F and becomes mixed with the carbonated water.

Thus, even in the case of accidental deviation by several millimeters of the path of the thread of syrup from its normal path, the thread of syrup still falls into the flow of carbonated water at the output of the throat.

With a continuous saturator, a system of ducts and dispensing apparatus of a given size it is possible to obtain at the outlet of the dispensing spout according to the invention carbonated water having a degree of residual carbonation of 4.5 to 4.7 volumes of carbon dioxide per unit volume of water whereas only 3.9 to 4 volumes are obtained with a simple pipe. This result is especially important for syrups which require high residual carbonations, of the order of 4.5 volumes.

The residual carbonation may be rendered less or even suppressed altogether by reducing the volume of carbonated water fed or by injecting uncarbonated water into the carbonated water. For this purpose the member 10 is provided with a lateral duct 28 inclined downwardly with respect to the vertical axis of the dispensing spout and opening into the duct 16. In the duct 28 is fixed a tip 30 on which is mounted a pipe connected to a reservoir of uncarbonated water, not shown in the drawings.

Figure 3:
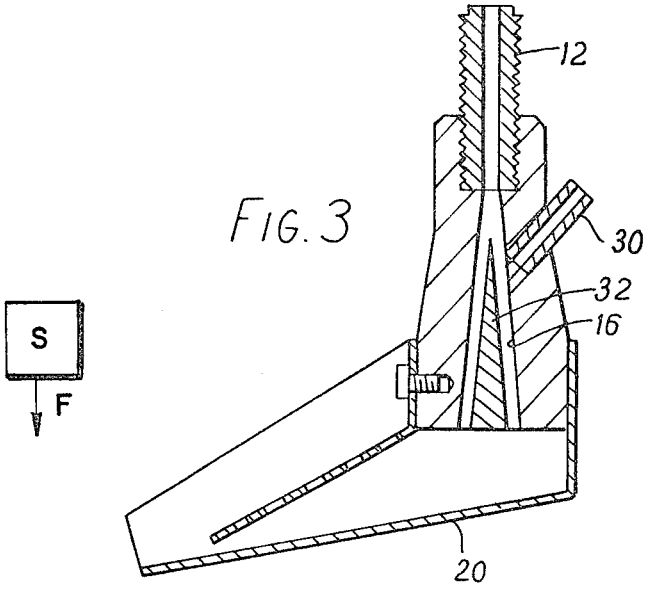
FIG. 3 is a variant of the dispensing spout of FIG. 1.

The dispensing spout shown in FIG. 3 is similar to that of FIG. 1 except that in the diverging member 16 there is fixed, by known means which are not shown, a conical member 32 intended to improve even further the flow of carbonated water.

FIGS. 4, 5 and 6 show a similar dispensing spout of plastics material which is moulded or machined. The throat 20 is formed by an independent member fixed to the member 10 by means of a screw 34.

In the dispensing spout of FIGS. 7 and 8 the diverging bore of the duct has in section a rectangular shape. The duct is formed of two members 36 and 38 of identical shape and each having on one of their faces a depression 40 and 42 respectively several millimeters in depth in the form of an isosceles trapezium having a small base to which is connected the bore 44 of the tip 46 for feeding gasified water. The members 36 and 38 are assembled together by means of screws 48, their faces which carry depressions 40 and 42 facing each other. Depressions 40 and 42 define between them a cavity 50 of a constant thickness which is relatively small and of which the cross-section increases progressively. A throat 52 and a grid 54 are fixed to the assembly thus obtained as indicated in FIG. 7. The member 42 is pierced with a duct 56 for feed of uncarbonated water. In an alternative arrangement one of the members 36 and 38 may be flat on two sides and the other comprises a depression of depth equal to the desired thickness of the cavity.

The opening-out duct below the tip 46 may have any other shape in cross-section, for example elliptical.

In the particular case of apparatus which make beverages from liquid stored in reservoirs the manner of mounting the spout is determined by the type of beverage and hence by the type of reservoir. It is possible to provide a single dispensing spout and a plurality of tubes each feeding a different syrup to provide a different beverage.

In the case of apparatus using unitary doses of syrup only a single spout is necessary.

I claim:

1. A dispensing head for dispensing beverages made from a concentrate and a diluting liquid, including a spout comprising a tubular element having input and output orifices for the diluting liquid, the cross-section of the bore of the tubular element increasing progressively from the input to the output orifice, a deflector arranged below said output orifice arranged to conduct liquid from the output orifice in a direction slightly inclined from the horizontal and discharge the liquid from an opening, a grid fixed within the deflector to distribute the flow of diluting liquid over the width of the deflector, and means for passing a stream of liquid concentrate in a substantially vertical direction downstream of said opening so that the stream of concentrate and the liquid discharged from the opening intersect.

2. A dispensing head according to claim 1, in which the bore of the tubular element is shaped as a trunk of a cone.

3. A dispensing head according to claim 1, in which the tubular element is formed of a single piece of metal or plastics material which is moulded or machined.

4. A dispensing head according to claim 1, provided with a conical member within the bore of the tubular element, a passage for diluting liquid being provided between the conical element and the inner surface of the tubular element.

5. A dispensing head according to claim 1, in which the bore of the tubular element has a rectangular cross-section.

6. A dispensing head according to claim 1, in which the tubular element is formed of two members opposed respective faces of which are held together, the opposed faces being provided with cavities of constant depth shaped as isosceles trapezia forming a bore of constant thickness and increasing width.

7. A dispensing head according to claim 1, in which the tubular element is formed of two members opposed respective faces of which are held together, one of the opposed faces being planar and the other being provided with a cavity of constant depth shaped as an isosceles trapezium to form a bore of constant thickness and increasing width.

8. A dispensing head according to claim 1, provided with a tubular tip member having a bore of the same crosssection as the bore of the tubular member at the input orifice and communicating with the input orifice.

9. A dispensing head according to claim 1, provided with a duct for feeding gas-containing diluting liquid to said input orifice and a duct for feeding ungasified liquid opening into the side of the bore of the tubular element at an acute angle with the bore.

* * * * *